US008425281B2

(12) United States Patent
Smith et al.

(10) Patent No.: US 8,425,281 B2
(45) **Date of Patent: *Apr. 23, 2013**

(54) ELECTRIC ABRASIVE SHARPENER

(75) Inventors: Richard S. Smith, Hot Springs, AR (US); Louis Chalfant, Hot Springs, AR (US)

(73) Assignee: Smith's Consumer Products, Inc, Hot Springs, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/494,809

(22) Filed: Jun. 12, 2012

(65) Prior Publication Data

US 2012/0258651 A1 Oct. 11, 2012

Related U.S. Application Data

(63) Continuation of application No. 12/381,759, filed on Mar. 16, 2009, now Pat. No. 8,206, 199.

(60) Provisional application No. 61/069,489, filed on Mar. 14, 2008.

(51) Int. Cl.
*B24B 3/54* (2006.01)

(52) U.S. Cl.
USPC ..... 451/192; 451/194

(58) Field of Classification Search ..... 451/192, 451/194

See application file for complete search history.

(56) References Cited

U.S. PATENT DOCUMENTS

| | | | | | |
|---|---|---|---|---|---|
| 1,115,824 | A | * | 11/1914 | Jenkins | 451/194 |
| 1,438,098 | A | * | 12/1922 | Delzell | 451/194 |
| 1,734,494 | A | * | 11/1929 | Kohlmiller | 451/194 |
| 2,035,249 | A | * | 3/1936 | Steiner | 451/192 |
| 3,461,616 | A | * | 8/1969 | Nissen et al. | 451/45 |
| 3,758,993 | A | * | 9/1973 | Kirtz | 451/194 |
| 4,038,782 | A | * | 8/1977 | Cozzini | 451/72 |
| 4,265,055 | A | * | 5/1981 | Cartwright et al. | 451/45 |
| 4,807,401 | A | * | 2/1989 | Atwater | 451/45 |
| 4,916,817 | A | * | 4/1990 | Atwater | 30/346.55 |
| 6,386,952 | B1 | * | 5/2002 | White | 451/45 |
| 6,860,796 | B2 | * | 3/2005 | White | 451/45 |
| 8,206,199 | B2 | * | 6/2012 | Smith et al. | 451/192 |

* cited by examiner

*Primary Examiner* — Maurina Rachuba
(74) *Attorney, Agent, or Firm* — Edward D. Gilhooly

(57) ABSTRACT

An electric abrasive sharpener for sharpening edges having pairs of interlocking abrasive wheels formed with opposite abrasive helical threads. Each end of the threads respectively has lead-in section and lead-out section having chamfer edge portion to eliminate kickback. The abrasive wheels of the sharpener is driven by a single phase AC motor connected to a motor drive that steps down the rotational speed of the output shaft of the motor to rotate the abrasive wheels with increased torque.

10 Claims, 7 Drawing Sheets

ELECTRIC ABRASIVE SHARPENER

This application is a continuation of application Ser. No. 12/381,759 filed Mar. 16, 2009 now U.S. Pat. No. 8,206,199 which in turn claims priority to provisional application Ser. No. 61/069,489 filed Mar. 14, 2008.

BACKGROUND OF THE INVENTION

1. Field of the Invention

This invention relates to abrasive sharpeners, and more particularly, to an electric powered abrasive sharpener having counter-rotating wheels.

2. Summary of the Prior Art

Numerous self-powered, electric abrasive sharpeners have been developed in the past. Although some past designs produce satisfactory results, the self-powered systems in the prior art are relatively expensive and must rely on the use of heavy duty electric motors for attaining adequate torque to satisfactorily drive the abrasive wheels. Another problem associated with known electric sharpeners is the danger and inconvenience to the user experiencing kick back of the blade being sharpened. In addition, prior designs of electric sharpeners do not provide an optimum sharpening surface on the abrasive wheels for best results. Accordingly, it is desirable in the prior art to provide an economical electric sharpener capable of developing optimum torque to the wheels for effective sharpening.

SUMMARY OF THE INVENTION

It is therefore an objective of the invention to provide an improved electric sharpener for knives, scissors, and other implements. The sharpener herein employs counter-rotating abrasive wheels with raised interconnecting abrasive threads that have a lead in and lead out chamfer to eliminate the kick back of the blade when being sharpen. The presence of the chamfers allows the grinding wheels to be flat to create a greater sharpening surface that is exposed on the wheel as compared to convex surfaces on wheels in the prior art. The unique drive train of the invention has an improved array of gears and belts that in conjunction with the sizing of the abrasive wheels allows the sharpener disclosed herein to employs a highly economical motor, while generating sufficiently high torque to the abrasive wheels for efficient sharpening. Although the electric sharpener herein is described in relation to four abrasive wheels forming two sharpening slots, the invention may be provided in accordance with teachings described as having a pair of counter rotating wheels forming one sharpening slot or more than two pairs of rotating abrasive wheels, if desired. Regardless of the number pairs of abrasive wheels employed, the pairs of wheels are respectively interconnected with a nesting design allowing for smaller wheels than compared to the prior art.

DESCRIPTION OF THE PREFERRED EMBODIMENT

Figure 1:
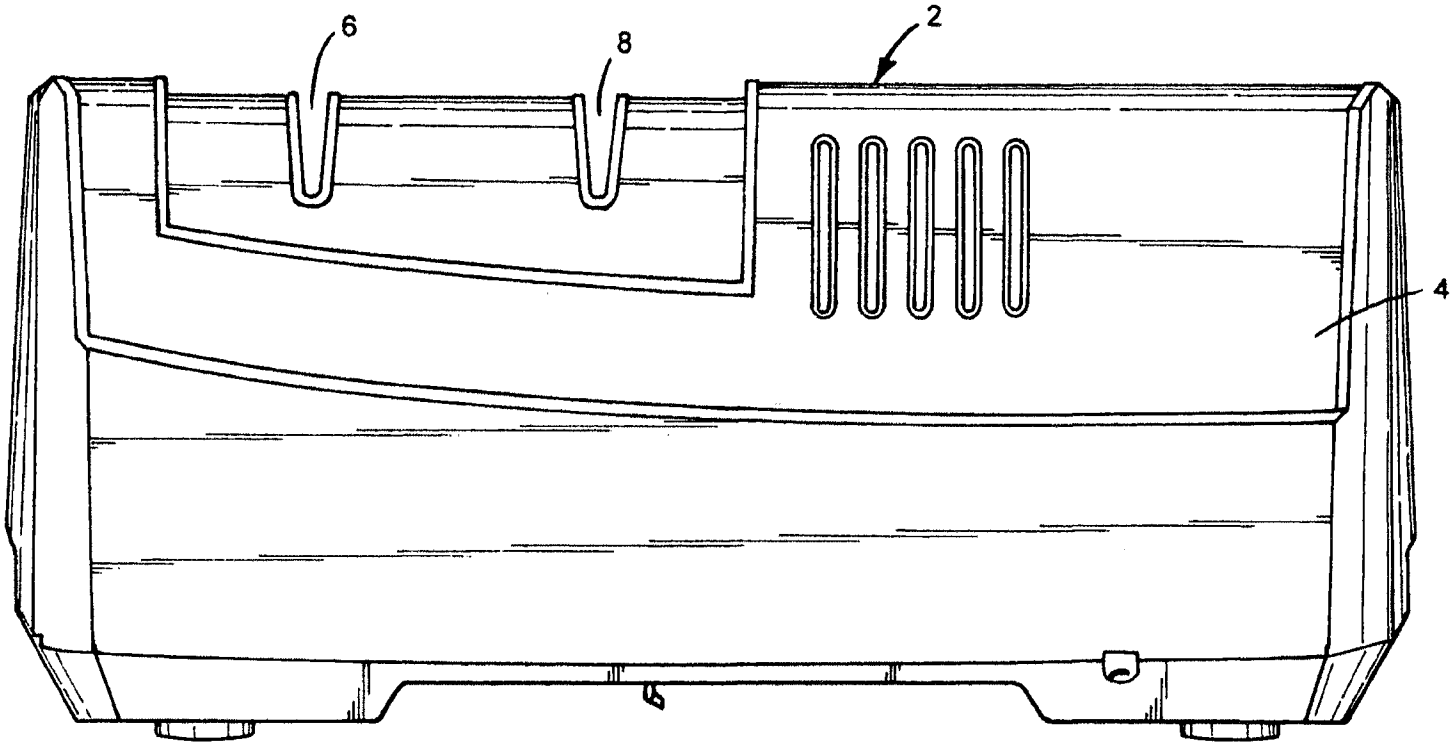
FIG. 1 is a rear elevational view of the electric abrasive sharpener of the invention.
Figure 2:
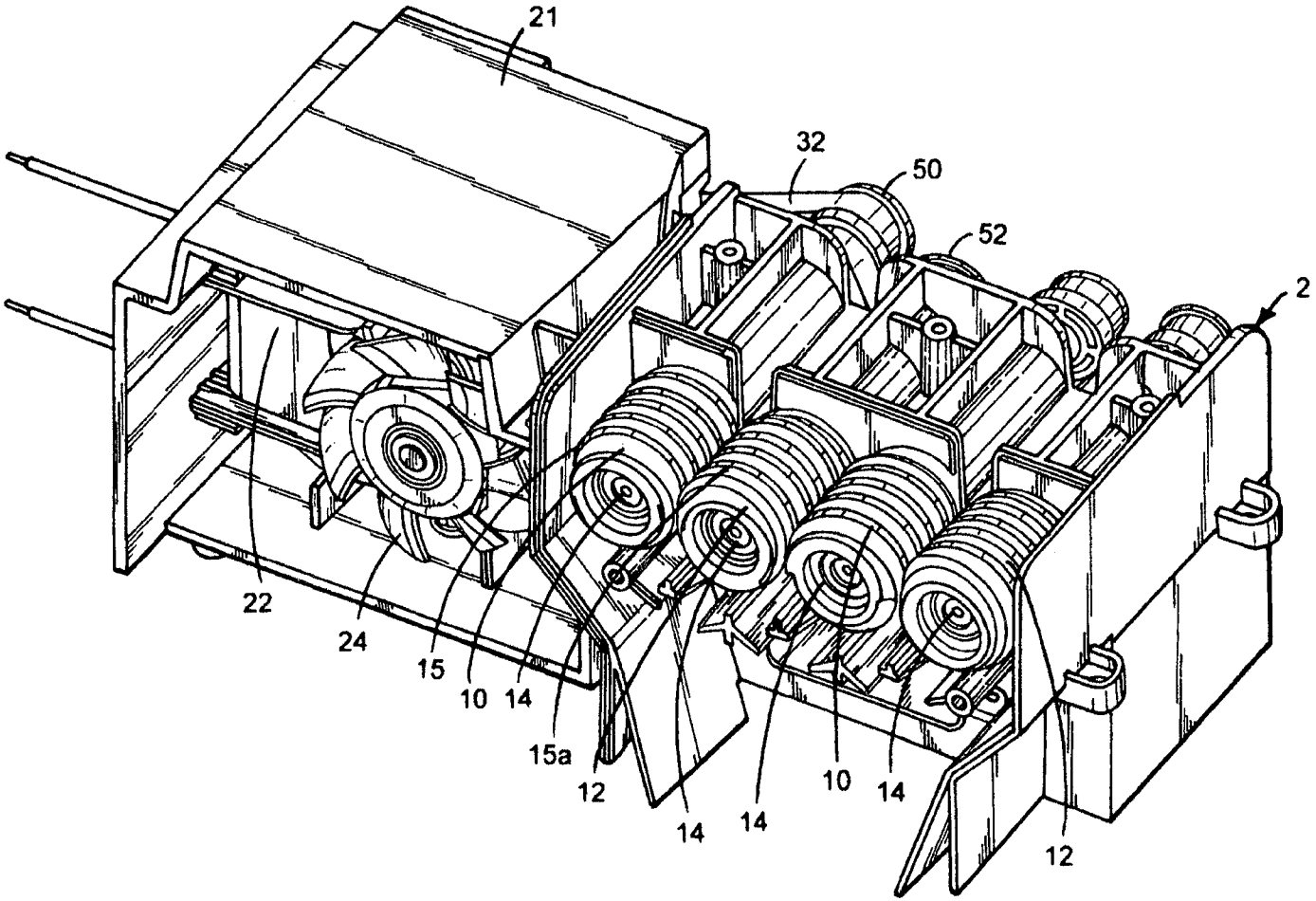
FIG. 2 is a partial front perspective view, with parts removed, of the electric abrasive sharpener of FIG. 1.
Figure 3:
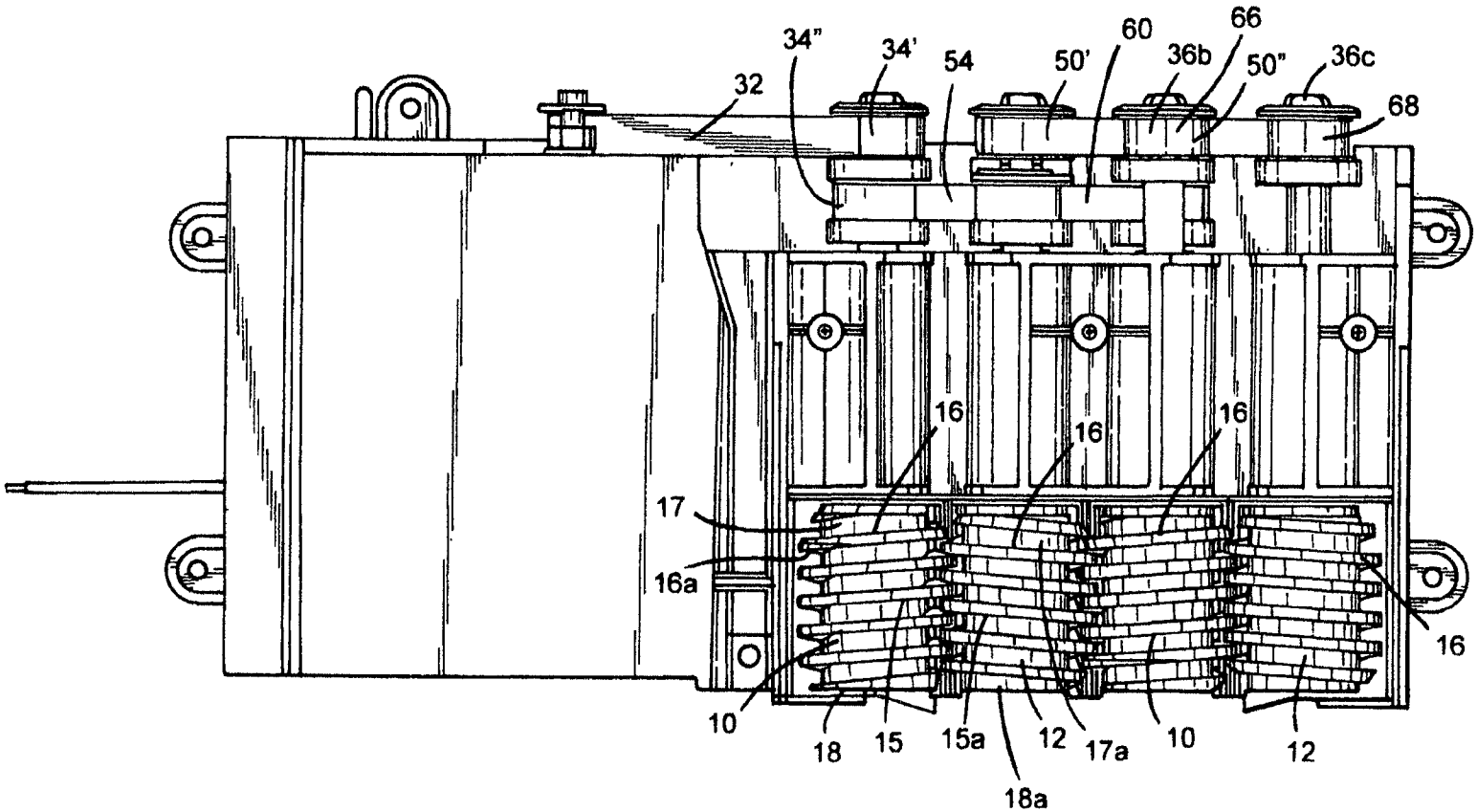
FIG. 3 is a top plan view, with parts removed, of the sharpener of FIG. 1.
Figure 4:
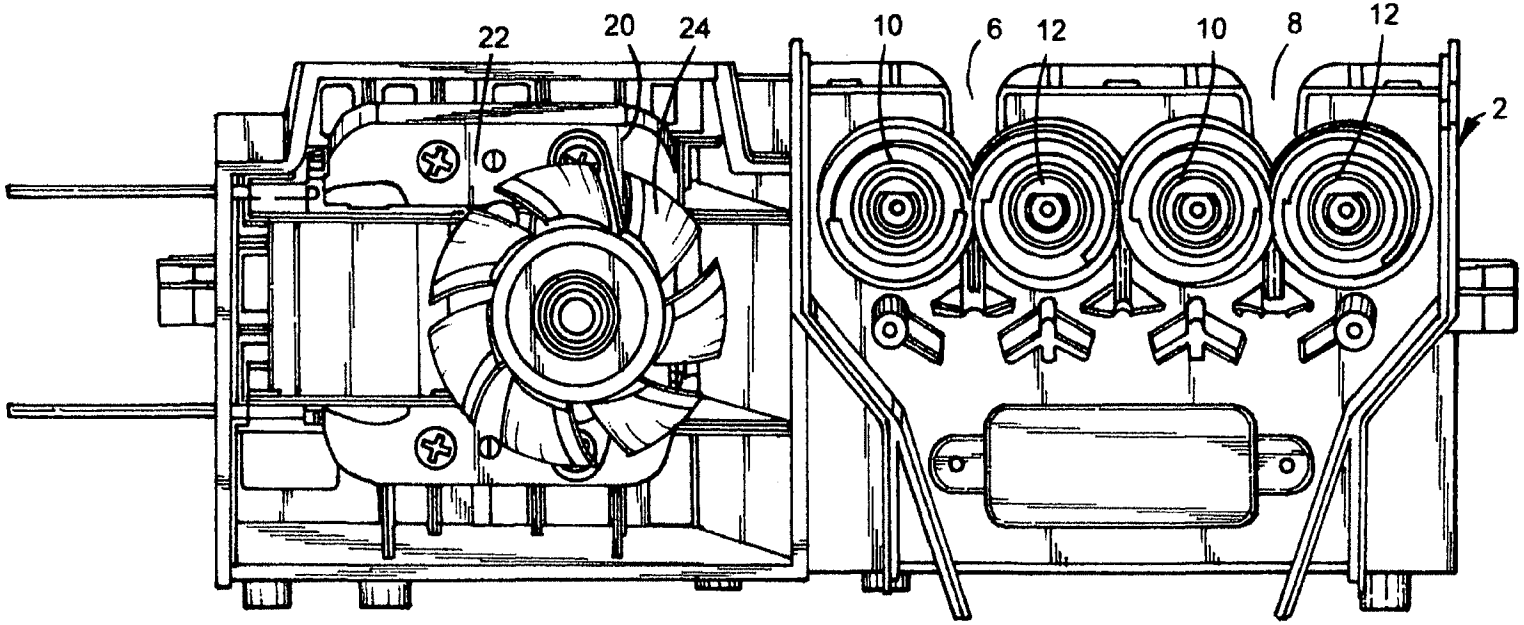
FIG. 4 is a front elevational view, with parts removed, of the sharpener of FIG. 1.
Figure 5:
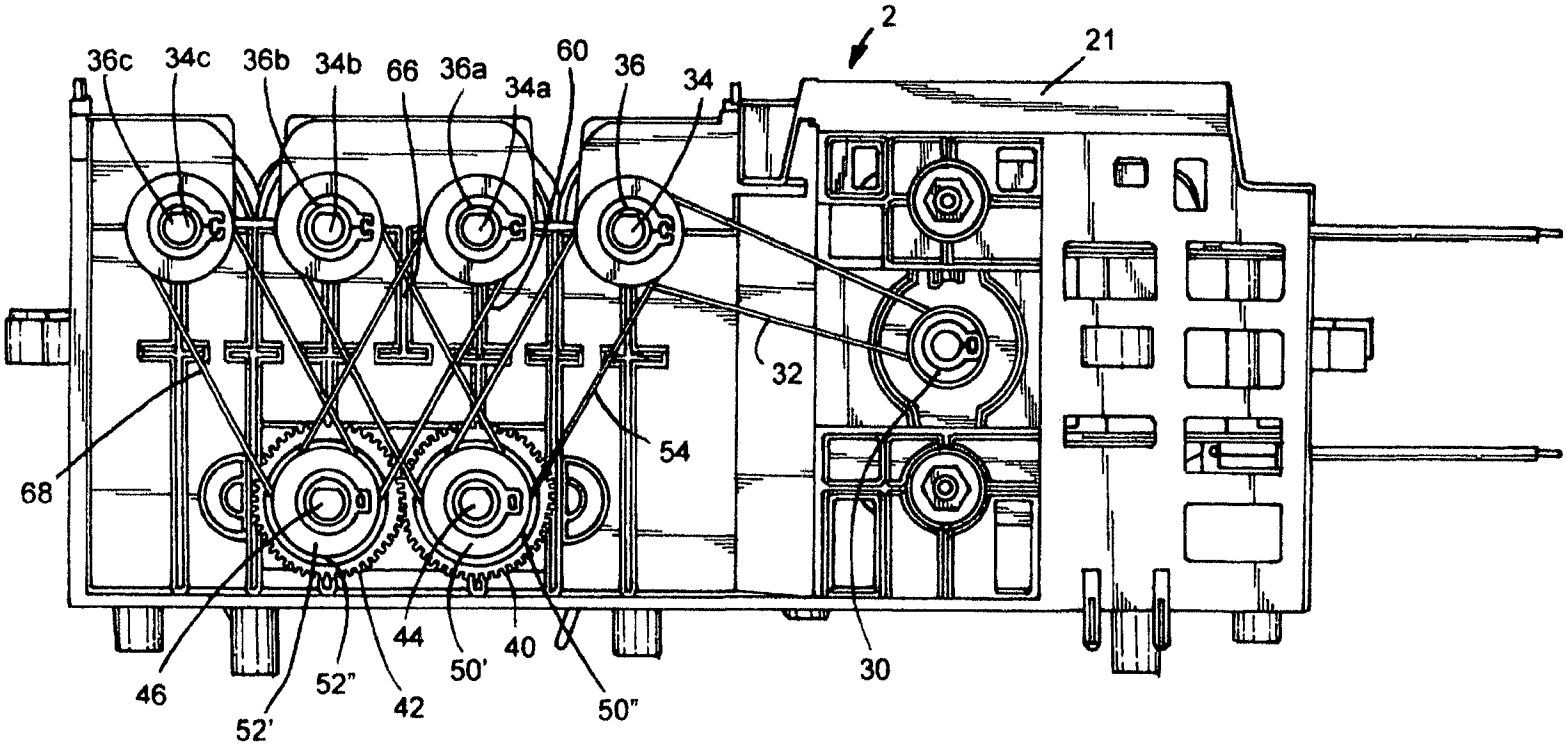
FIG. 5 is a back elevational view, with parts removed, of the sharpener of FIG. 1.
Figure 6:
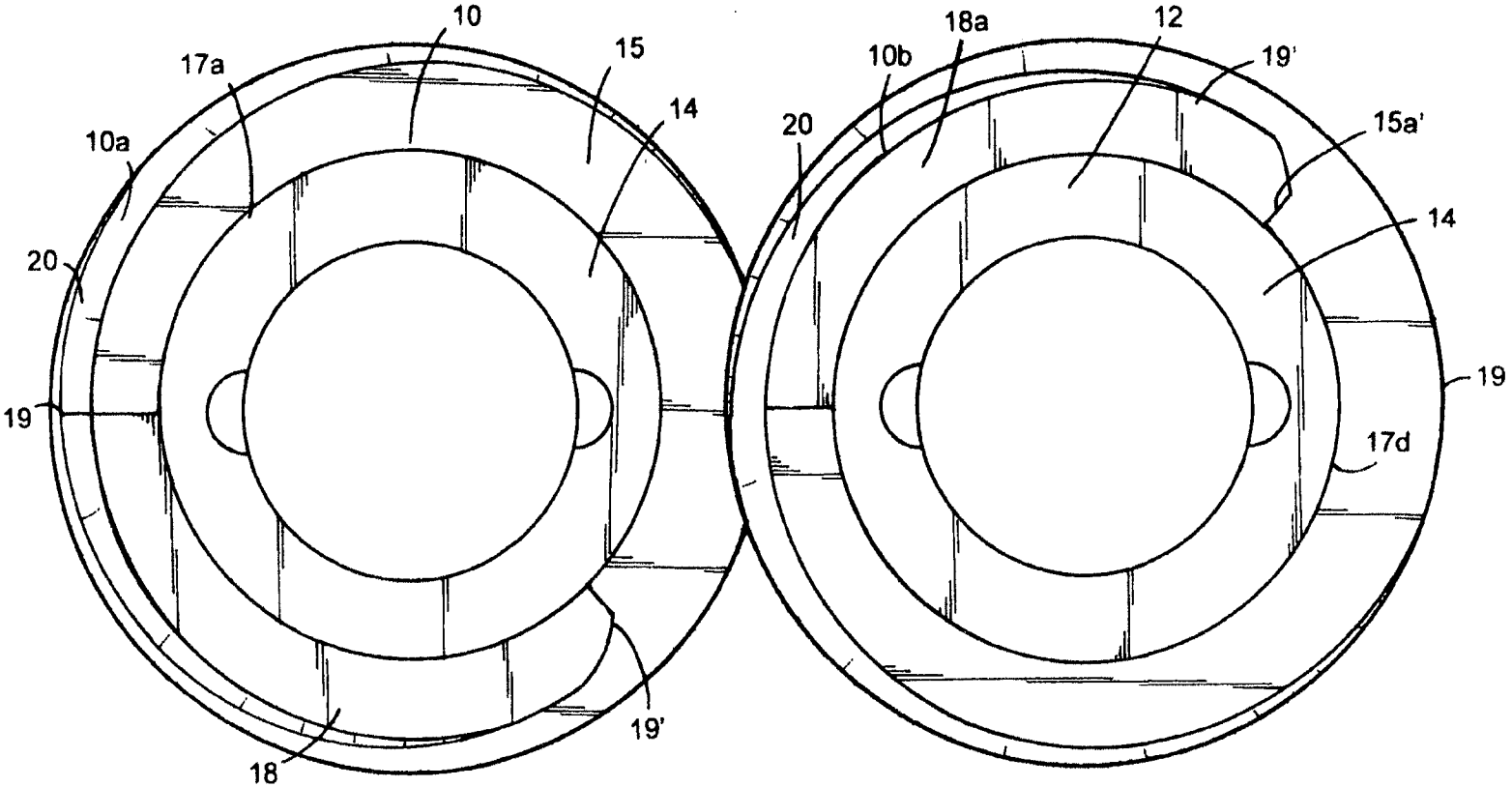
FIG. 6 is a partial end elevational view of a pair of abrasive wheels of the sharpener of FIG. 1.
Figure 7:
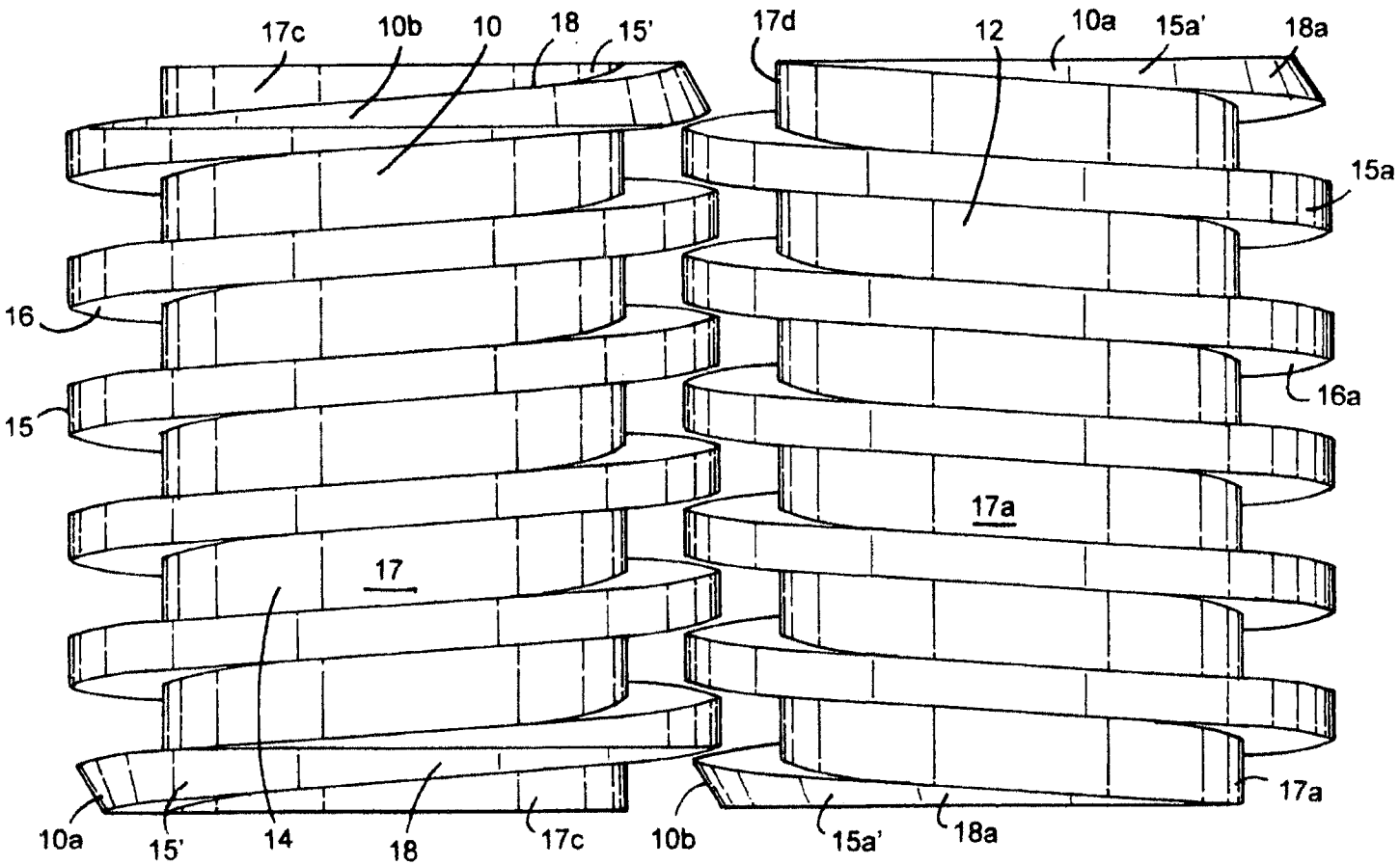
FIG. 7 is. a partial top plan view of a pair of abrasive wheels of the sharpener of FIG. 1.

Referring now to FIGS. 1-7, there is illustrated the electric sharpener of the invention, generally designated by reference numeral 2. The sharpener 2 has a hollow housing 4 made of metal or plastic and the like. For purposes of manufacture, a combination of plastic and metal may be used effectively used to form housing 4. The housing 4 includes a pair of V-shaped slots 6 and 8 in which a pair of counter-rotating abrasive wheels 10 and 12, having a diamond abrasive or other suitable material is respectively mounted in sharpening slots 6 and 8. The wheels 10 and 12 have a central hub 14 respectively having integral helical ridges 15 and 15*a* in the form of raised continuous threads of generally the same radius from hub 14 as illustrated in FIGS. 4, 6, and 7. The ridges 15 and 15*a* overlap a portion of each other, whereby, for example, ridges 15 form right handed threads and ridges 15*a* form left handed threads. An abrasive material is affixed to outer peripheral surfaces 16 of the ridges 15, 15*a* and side walls 16, 16*a* thereof, and the surfaces 17, 17*a* of hub 14 respectively disposed between the ridges 15,15*a* of abrasive wheels 10 and 12. A portion of the periphery of a respective ridge 15 or ridge 15*a* is disposed between two portions of the ridge of the adjacent abrasive wheel during rotation in intermeshing relationship as seen in FIG. 7.

The initial helical ridges 15' and 15*a'* at each end of wheels 10 and 12 are formed as partially raised ridge portions 18,18*a* as seen in FIGS. 6 and 7. From the views in FIGS. 3 and 6, the first ridges portions 15' and 15*a'* are not formed on surfaces 17*c* and 17*d* of hub 14 at each end of abrasive wheels 10 and 12 for an extent of approximately 180°. The first formed partial portions 18, 18*a* of the ridges 15' and 15*a"* gradually are formed on hub 14 and respectively extend from surfaces 17*c* and 17*d* at area 19 to area 19' with a varying raised radius having an elliptical pattern (FIG. 6). At area 19', the first formed portions 18,18*a* at each end of the wheels 10 and 12 are integral with the initial full helical ridge portion of the respective ridges 15 and 15*a*. As seen in FIGS. 4, 6 and 7, the peripheral edges 18', 18*a'* (FIG. 7) of the partial ridge portions 18,18*a* are beveled at an edge portion 20 to form lead-in and lead-out chamfers 10*a*, 10*b* respectively at both ends of abrasive wheels 10 and 12. Without being so limited and for sake of description only, the chamfers 10*a*, 10*b* at the rear of wheels 10, 12 are considered lead-in chamfers, because they are positioned adjacent the entry point of edge as it pulled through the sharpening slot. The chamfers 10*a*, 10*b* are lead-out chamfers where the knife exits from the slot at the front of the housing as it is pulled through wheels 10 and 12 during sharpening. The lead in and lead-out chamfers 10*a* 10*b* (FIG. 6) eliminate the kick back on the knife blade during sharpening as occurs in the prior art and allows the abrasive wheels 10 and 12 to present an increased sharpening surface that is exposed on the wheels. As seen in FIGS. 1-5, although two sharpening slots 6 and 8 containing the counter-rotating wheels 10 and 12 are shown, it is within the scope of the invention to use one or more than two slots, if desirable. Enhanced sharpening also is provided by the invention because the abrasive wheels 10, 12 rotate upward toward the top of the housing 4 such that both sides of the blade edge are sharpened at the same time. The nesting wheels 10 and 12 herein further maintain parallelism between the wheels and knife during sharpening.

As seen in FIG. 2, the housing 4 includes a motor enclosure 21 in which an electric motor 22 having fan 24 is mounted to be driven by an external voltage source (not shown) or alternatively by a rechargeable battery in a conventional manner. Because of the unique power drive 26 of the invention to be described later herein, the electric motor 22 is a highly economical, low torque electric motor, such as a single phase induction motor. One type of an AC single phase motor is known as a shaded-pole motor of conventional design. The power drive 26 is capable of stepping down the rotation output of the motor 22, such that a significant torque is generated to the abrasive wheels 10 and 12 for effective sharpening. Dependent on the rotation of the motor output shaft, the ratio of the gears and pulleys, and desired sharpening results, a step down of rotational speed at the motor output by approximately one half has been found to be satisfactory. The design of the invention is not only economical, but generates the torque of much more expensive, powerful sharpeners which require abrasive wheels having an increased diameter as compared to abrasive wheels 10 and 12 herein.

The motor 22 is provided with an output shaft 30 having an output pulley (FIGS. 3 and 5) that drives a continuous looped belt of conventional design. The power drive 26 includes an upper lead pulley 34 having two pulley sections 34' and 34" is mounted on a shaft 36 rotatably carried on the housing 4. Pulleys 34*a*, 34*b*, and 34*c* are further rotatably mounted in spaced relationship to pulley 34 respectively on shafts 36*a*, 36*b* and 36*c* (FIGS. 3 and 5). As seen in FIG. 3, pulley 32*b* is laterally offset from the pulleys 34*c* and 34*d*. The abrasive wheels 10 are mounted in affixed manner to the opposite ends of shafts 36 and shaft 36*b*. The abrasive wheels 12 are affixed to opposite ends of shafts 36*a* and 36*c*. The continuous belt 32 is driven by motor 22 and is connected to pulley section 34' to rotate pulley 34 and shaft 36 in a clockwise direction.

As seen in FIG. 5, a pair of meshing pinion gears 40 and 42 is rotatably mounted on shafts 44 and 46 beneath the pulleys 34, 34*a*, 34*b*, and 34*c*. A gear pulley assembly 50 having spaced pulley outer sections 50' and inner pulley 50" is mounted on a horizontal shaft rotated by gear 40. A gear pulley assembly 52 having spaced outer pulley sections 52' and inner pulley section 52" is mounted on a horizontal shaft rotated by gear 42. A continuous drive belt 54 extends between inner gear pulley section 50" and pulley section 34" for rotation of intermeshing gears 40 and 42 as provided by the output of the motor 22. A continuous belt 60 extends from gear pulley section 52" to pulley 34*a* to rotate shaft 36*a* in a counter-clockwise direction. A continuous belt 66 extends from gear pulley section 50' to pulley 34*b* to rotate shaft 36*b* in a clockwise direction. A continuous belt 68 extends from gear pulley section 52" to pulley 34*c* to rotate shaft 36 *c* in a counterclockwise direction.

In operation, the motor drives shaft 36 and gear 40 in a clockwise direction, whereby the gears 40 and 42 rotate in opposite directions thus rotating shafts 36 and 36*b* in a clockwise direction opposite to the counter-clockwise rotation of shafts 36*a* and 36*c* to rotate respective pairs of abrasives wheels 10, 12 in opposite interconnecting relationship. The blade being sharpened is generally pulled through either of sharpening slots 6 and 8 from the rear to front. During the stroke sharpening a knife, the lead-in and lead-out chamfers 10*b* insure that the blade is not kicked away from the sharpener while its edge progressively either enters or exits sharpening slots 6 and 8.

What is claimed is:

1. An electric abrasive sharpener for sharpening an edge comprising a housing supporting a pair of interconnecting abrasive wheels mounted for rotatable movement in a sharpening slot, each of said abrasive wheels respectively having a raised helical thread extending in a radial direction continuously generally along the length of said abrasive wheels, a portion of one of said helical threads being disposed between two portions of the other of said helical threads during rotation for contacting the edges, a power drive connected to said pair of abrasive wheels for rotation in opposite directions about respective longitudinal axes, said helical threads having thread portions at the lead-in and lead-out portions respectively at each end of said abrasives wheels, said initial thread portions of said helical threads having peripheral edges at said lead-in and said lead-out portions, and said peripheral edges of at least one of said lead-in and said lead-out portions being substantially beveled along a plane intersecting said respective axes of rotation to form chamfers to reduce kick-back of the edge being sharpened.

2. The sharpener according to claim 1 wherein said one of said lead-in and lead-out portions are said lead-out portions.

3. The sharpener according to claim 1 wherein said thread portions of least one of said lead-in and lead-out portions have a varying radius.

4. An electric abrasive sharpener for sharpening edges comprising a pair of abrasive wheels disposed adjacent each other in an interconnected relationship to sharpen an edge moving therebetween and being rotatable about respective longitudinal axes, one of said abrasive wheels having raised right-handed threads formed with an abrasive and extending from a partial lead-in end to a partial lead-out end on said one abrasive wheel, said other of said pair of abrasive wheels having raised left-handed threads formed with an abrasive and extending from another partial lead-in end to another partial lead-out end of said other abrasive wheel, and said right-handed threads and said left-handed threads each having a chamfer section being beveled substantially along a plane intersecting said axes of rotation on at least one of said partial lead-in end and said partial lead-out end.

5. The sharpener according to claim 4 wherein said at least one chamfer is substantially beveled on said partial lead-out end.

6. The sharpener according to claim 4 wherein said pair of abrasive wheels respectively includes a cylindrical hub, said right handed threads and said left handed threads being formed on a respective hub, said partial lead-in and said lead-out ends extending upward from said hub to integral relationship to said right handed threads and said left handed threads.

7. The sharpener according to claim 4 wherein said partial threaded ends having a curved upper edge generated by a varying radius.

8. An electric abrasive sharpener for sharpening edges comprising at least one abrasive wheel disposed to sharpen an edge moving relative thereto and said at least one abrasive wheel being rotatable about a longitudinal axis, said at least one abrasive wheel having raised threads formed with an abrasive and extending from a lead-in end section to a lead-out end section on said at least one abrasive wheel, and said raised threads having a chamfer section being beveled substantially along a plane intersecting said axis of rotation on at least one of said partial lead-in end section and said partial lead-out end section.

9. The sharpener according to claim 8 wherein said raised threads of said lead-out section is beveled substantially along a plane intersecting said axis of rotation.

10. The sharpener according to claim 8 wherein said beveled threads having a varying radius relative to said axis of rotation.

* * * * *